US008394162B2

(12) United States Patent
Lin

(10) Patent No.: US 8,394,162 B2
(45) Date of Patent: Mar. 12, 2013

(54) DUST COLLECTOR

(76) Inventor: Tony Lin, Taichung (TW)

( * ) Notice: Subject to any disclaimer, the term of this patent is extended or adjusted under 35 U.S.C. 154(b) by 213 days.

(21) Appl. No.: 13/094,649

(22) Filed: Apr. 26, 2011

(65) Prior Publication Data

US 2012/0272631 A1 Nov. 1, 2012

(51) Int. Cl.
*B01D 53/00* (2006.01)

(52) U.S. Cl. ..... 55/429; 55/356; 55/357; 55/428; 55/502; 55/337; 55/522; 55/525; 55/DIG. 3

(58) Field of Classification Search ..... 55/356–357, 55/428, 429, 502, 337, 522, 525
See application file for complete search history.

(56) References Cited

U.S. PATENT DOCUMENTS

| | | | | |
|---|---|---|---|---|
| 6,546,593 | B2 * | 4/2003 | Oh et al. | 15/353 |
| 6,797,046 | B2 * | 9/2004 | Wang | 96/421 |
| 7,329,295 | B2 * | 2/2008 | Greene et al. | 55/337 |
| 7,341,611 | B2 * | 3/2008 | Greene et al. | 55/337 |
| 7,419,522 | B2 * | 9/2008 | Arnold | 55/345 |
| 7,740,676 | B2 * | 6/2010 | Burnham et al. | 55/345 |
| 8,021,453 | B2 * | 9/2011 | Howes | 55/447 |
| 2005/0198767 | A1 * | 9/2005 | Kang et al. | 15/353 |
| 2005/0198770 | A1 * | 9/2005 | Jung et al. | 15/353 |
| 2006/0101611 | A1 * | 5/2006 | Oh et al. | 15/353 |
| 2007/0084165 | A1 * | 4/2007 | Nakai et al. | 55/429 |
| 2008/0078148 | A1 * | 4/2008 | Burnham et al. | 55/429 |

* cited by examiner

*Primary Examiner* — Jason M Greene
*Assistant Examiner* — Dung H Bui

(57) ABSTRACT

A dust collector of the present invention includes a main body, a first dust container, and two lifting apparatuses. The main body includes a shell, an expandable pipe, and a lid. The expandable pipe, which is vertically expandable, is connected between the shell and the lid. The first dust container is detachably disposed on the main body and is used to be selectively covered by the lid. The two lifting apparatuses respectively include a base, a linking up mechanism, and an operating rod. The two bases are respectively fixed on two sides of an outer wall surface of the shell. The operating rod is movably disposed on the base. One end of the linking up mechanism is disposed on the operating rod, and the other end is fixed on the lid. Thereby, the lifting apparatus can horizontally lift the lid.

8 Claims, 5 Drawing Sheets

DUST COLLECTOR

BACKGROUND OF THE INVENTION

1. Field of the Invention

The present invention relates to a lifting apparatus for lid, and more particularly to a lifting apparatus for lifting a container lid of the dust collector.

2. Description of the Prior Art

A conventional dust collector, as shown in US Publication No. 20090158549, provides a lifting apparatus to lift a lid of a container of the dust collector. However, the lifting apparatus is fixed on one side of the lid, so that the lid is slanted when being lifted up. Further, the slanted lid is difficult to horizontally and completely cover the container when it is pushed downward, so it even needs to be pressed evenly by hand. That is because the force point of a pushing rod of the lifting apparatus is located out of the lid, so that the lifting force is focused on one side of a pressing bar of the lifting device. In this way, the pressing bar is prone to break. In addition, said lifting apparatus needs to be further disposed with the pressing bar on said dust collector, so it will occupy more space and increase the production cost.

Another dust collector, as shown in U.S. Pat. No. 5,089,037, provided a lifting apparatus which includes a pulley set, a reel unit, and a plurality of slidable holders for evenly lifting up a lid of the dust container. However, said dust collector requires many pulleys and holders on its main body. Moreover, to make the force applied completely and efficiently to lifting the lid, the pulleys of the lifting apparatus need a long distance between each other. Consequently, said dust collector occupies large space and has a heavy weight.

There are other conventional lifting apparatuses like U.S. Pat. No. 3,885,700 which is applied to lifting the lid of a garbage can. However, the lifting apparatus neither can horizontally lift the lid, and the lifting apparatus needs to be fixed on a wall in order to lever the lid.

Therefore, the present invention is arisen to obviate or at least mitigate the above mentioned disadvantages.

SUMMARY OF THE INVENTION

The main object of the present invention is to provide a dust collector which has a lifting apparatus for lid, and the lifting apparatus can horizontally lift a lid. In addition, the force point of the lifting apparatus is located on the lid, and the lifting apparatus has a small volume without occupying too much space.

To achieve the above and other objects, a dust collector of the present invention includes a main body, a first dust container, and two lifting apparatus. The main body includes a shell, an expandable pipe, and a lid. The shell comprises a suction apparatus, an inlet pipe, and an outlet pipe. The suction apparatus is adapted to suck outside air through the inlet pipe to inside of the shell, and discharge the air from the outlet pipe. The expandable pipe, which is vertically expandable, is connected between the shell and the lid. The first dust container is detachably disposed on the main body, and adapted to be selectively covered by the lid. The two lifting apparatuses respectively include a base, a linking up mechanism, and an operating rod. The bases are respectively fixed on two sides of an outside wall surface of the shell. The operating rod is movably disposed on the base. One end of the linking up mechanism is disposed on the operating rod, and the other end is fixed on the lid. The operating rod can pivot on an axis with respect to the base between a first position and a second position, and the operating rod brings the mechanism up and down so as to move the lid with respect to the first dust container between an open position and a closed position.

Thereby, the lid can be horizontally lifted up by the two lifting apparatuses. And when the lid is pressed downward, it can evenly and completely cover the opening of the first dust container. Further, force point of the lifting apparatus focuses on the lid, so the linking up mechanism will not break. Moreover, the base of the lifting apparatus is directly disposed on the shell without increasing the volume of the dust collector.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
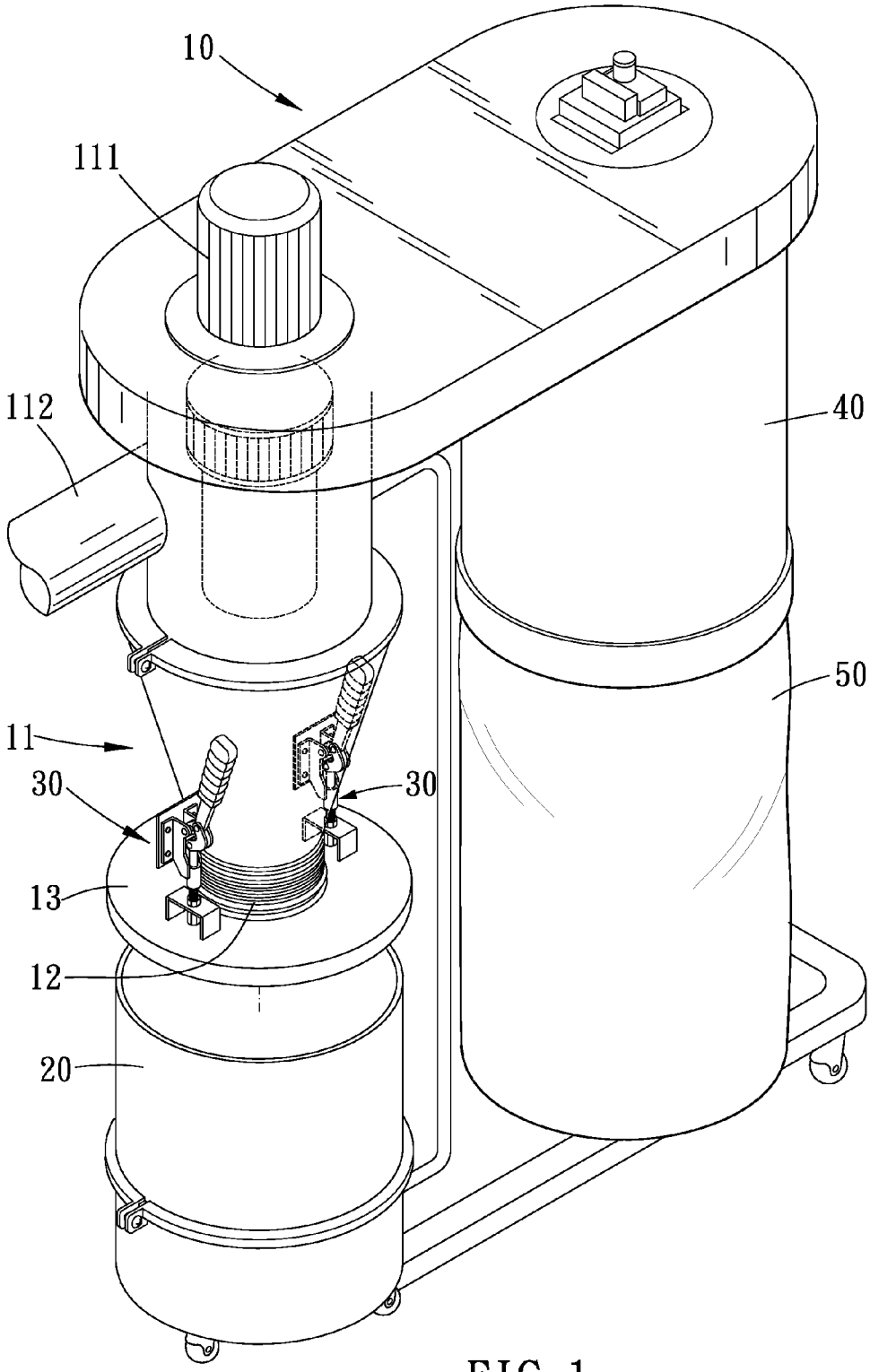
FIG. 1 is a stereogram showing a preferred embodiment of the present invention.
Figure 2:
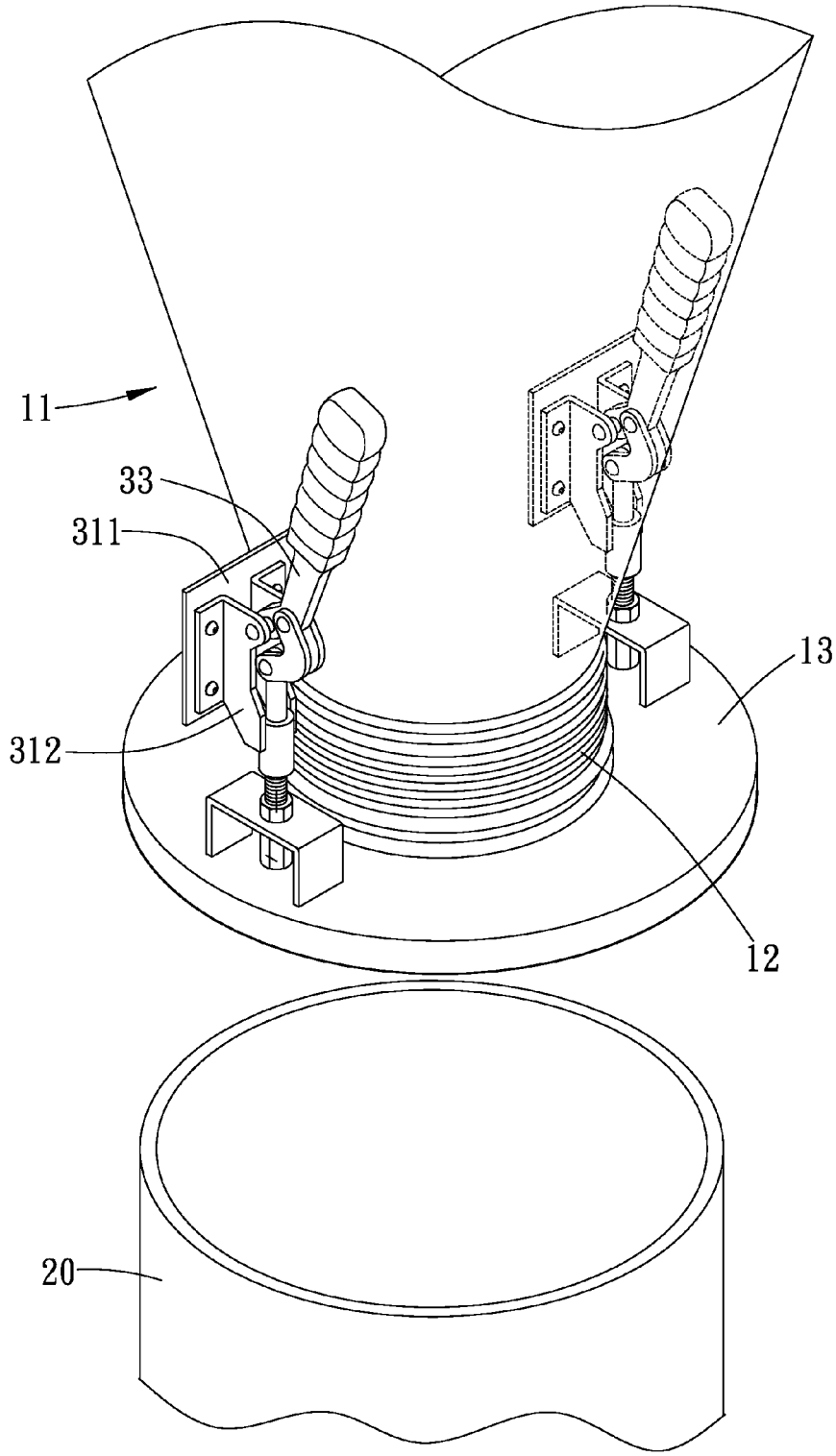
FIG. 2 is a partially enlarged drawing showing a preferred embodiment of the present invention.

Please refer to FIG. 1, FIG. 2. The dust collector of the present invention includes a main body 10, a first dust container 20, two lifting apparatuses 30, a second dust container 40, and a bag 50.

The main body 10 includes a shell 11, an expandable pipe 12, and a lid 13. The shell 11 comprises a suction apparatus 111, an inlet pipe 112, and an outlet pipe. The suction apparatus 111 is adapted to suck outside air through the inlet pipe 112 to inside of the shell, and discharge the air from the outlet pipe. The expandable pipe 12, which is vertically expandable, is connected between the shell 11 and the lid 13.

The first dust container 20 is detachably disposed on the main body 10, and the first dust container is adapted to be selectively covered by the lid 13. Specifically, the lid 13 includes a hole which communicates with the expandable pipe 12. Thereby, when the lid 13 is covered on the first dust container 20 and the suction apparatus 11 is activated, the heavy dust or chips outside will pass through the hole and fall off to the first dust container 20.

Figure 3:
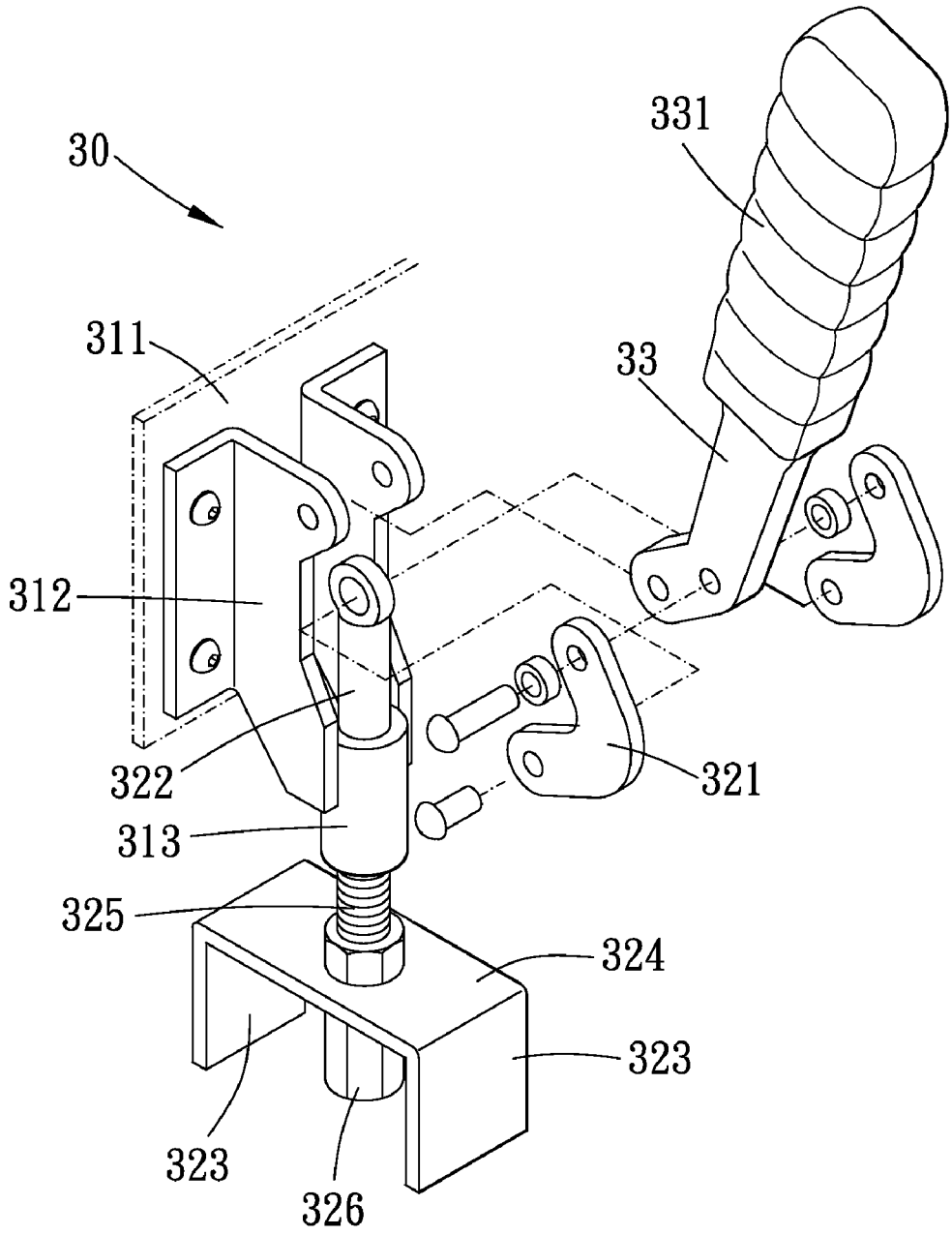
FIG. 3 is a breakdown drawing showing the lifting apparatus of a preferred embodiment of the present invention.

Please refer to FIGS. 1 to 3. The two lifting apparatuses 30 respectively comprise a base, a linking up mechanism, and an operating rod 33. The two bases are respectively fixed on two sides of an outside wall surface of the shell. The operating rod 33 is movably disposed on the base. One end of the linking up mechanism is disposed on the operating rod 33, and the other end is fixed on the lid 13. The operating rod 33 is movable with respect to the base between a first position and a second position, and The operating rod 33 can bring the linking up mechanism to move up and down so as to move the lid 13 up and down with respect to the first dust container 20 between an open position and a closed position. In the present embodiment, each operating rod 33 has a sheath 331, and the operating rod 33 can pivot on an axis with respect to the seat.

Preferably, the seat includes a plate 311 and a pair of wing portions 312. The plate 311 radially extends from two sides of the outside wall surface of the shell, and the two plates 311 are symmetrical. The pair of wing portions 312 is disposed on one side of the plate 311. The operating rod 33 is disposed on the pair of wing portions 312. The linking up mechanism includes two V-shaped members 321, a rod 322, and a seat. One end of the two V-shaped members 321 is respectively disposed on two sides of the operating rod 33, and the other end of the two V-shaped members 321 is respectively disposed on two sides of one end of the rod 322. The other end of the rod 322 is disposed on the seat, and the seat is fixed on the lid 13. In the present embodiment, the base includes a sleeve 313 which is adapted for the rod 322 passing therethrough. The seat includes two end portions 323 and a connecting section 324. The two end portions 323 extend downward from the connecting section 324 to the lid 13, and the two end portions 323 are fixed on the lid 13. Preferably, the rod 322 includes a threaded section 325. The seat comprises a screwed mechanism 326. The threaded section 325 is screwed to the mechanism 326. Thereby, the rod 322 can be adjusted to correspond with the expandable distance of the expandable pipe 12 and the height of the dust collector 20.

Please refer to FIG. 1. The second dust container 40 is fixed on the main body 10, and the second dust container 40 communicates with the outlet pipe. The bag 50 is disposed to the second dust container 40 which is used for collecting the lighter dust into the bag 50.

Figure 4:
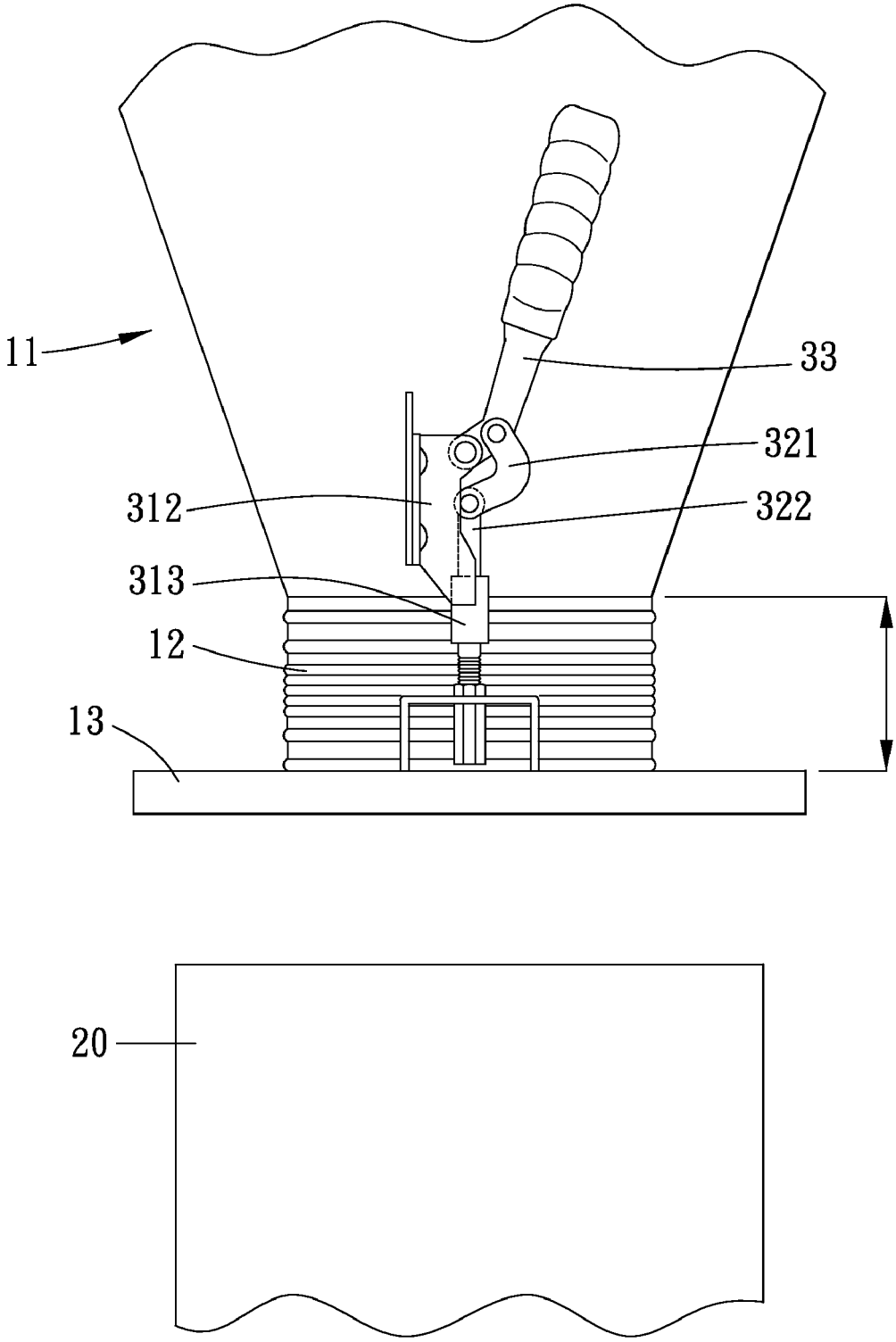
FIG. 4 is a schematic drawing showing the lifting apparatus of a preferred embodiment of the present invention; wherein the lifting apparatus lifts the lid up.
Figure 5:
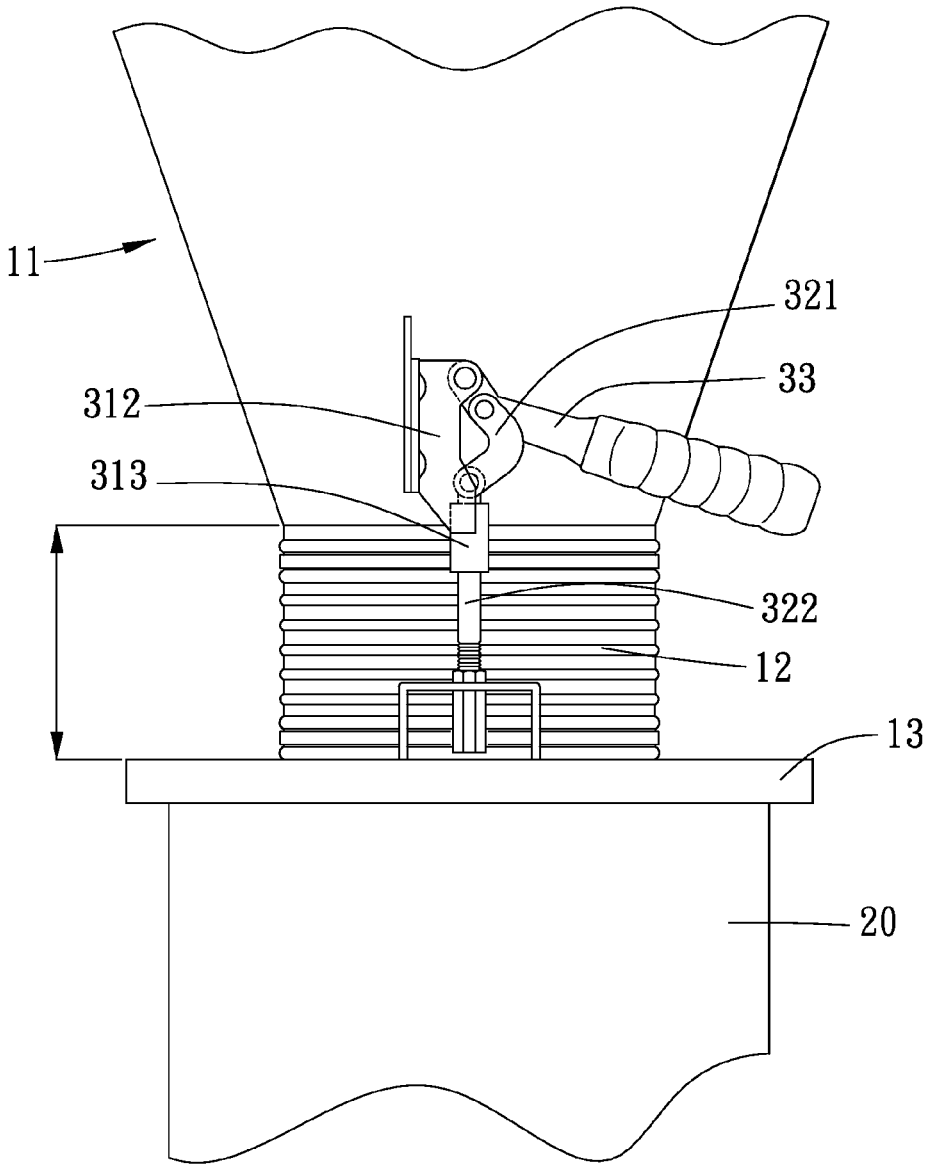
FIG. 5 is a schematic drawing showing the lifting apparatus of a preferred embodiment of the present invention; wherein the lifting apparatus brings the lid to cover the first dust container.

Please firstly refer to the FIG. 4. When the first dust container 20 is filled with dust or clips, a user can push each operating rod 33 upward to the first position. Each operating rod 33 will bring each V-shaped member 321 to move each rod 322 upward. And each rod 322 then lifts each seat up, so that each seat brings the lid 13 to move upward together. In the same time, the expandable pipe 12 retracts upward with the upward force of the lifting apparatus 30, and the lid 13 then is at an open position. Meanwhile the lid 13 is away from the first dust container 20, so the first dust container 20 can be moved out from the main body 10. The two lifting apparatus 30 are symmetrically located on both sides of the outside wall surface of the shell. Thereby, the lid 13 can be horizontally and evenly lifted up. Please further refer to FIG. 5. When the lid 13 is going to cover on the first dust container 20, the user just presses the operating rod 33 downward directly to the second position without making the lid horizontal by hand before pressing, and the lid 13 will completely and evenly cover on the first dust container 20.

In addition, the bases of the two lifting apparatus are directly fixed on the shell, so there is no need for other components, like a wall or a plate in the prior art, to fix the bases. In this way, the dust collector of the present invention has a small volume and a light weight, and does not require extra cost for installing extra components. Further, the position of the two seats makes the force point of the lifting apparatus focused on the lid, so that the two seats do not break.

What is claimed is:

1. A dust collector, comprising:

a main body, comprising a shell, a expandable pipe, and a lid, the shell comprising a suction apparatus, an inlet pipe, and an outlet pipe, the suction apparatus being adapted to suck outside air through the inlet pipe to inside of the shell and discharge the air from the outlet pipe, the expandable pipe, which is vertically expandable, being connected between the shell and the lid;

a first dust container, detachably disposed on the main body, the first dust container being adapted to be selectively covered by the lid;

two lifting apparatuses, respectively comprising a base, a linking up mechanism, and an operating rod, the two bases being respectively fixed on two sides of an external wall surface of the shell, the operating rod being movably disposed on the base, one end of the linking up mechanism being disposed on the operating rod, the other end of the linking up mechanism being fixed on the lid;

wherein, the operating rod is movable with respect to the base between a first position and a second position, the operating rod brings the linking up mechanism to move up and down so as to move the lid up and down with respect to the first dust container between an open position and a closed position.

2. The dust collector of claim 1, wherein each base comprises a plate and a pair of wing portions, the plate radially extends from the two sides of the outside wall surface of the shell, the two plates are symmetrical, the pair of the wing portions is disposed on one side of the plate, the operating rod is disposed on the pair of wing portions.

3. The dust collector of claim 1, wherein each linking up mechanism comprises two V-shaped members, a rod, and a seat, one end of the two V-shaped members is respectively disposed on two sides of the operating rod, the other end of the two V-shaped members is respectively disposed on two sides of one end of the rod, the other end of the rod is disposed on the seat, the seat is fixed on the lid.

4. The dust collector of claim 3, wherein the seat comprises two end portions and a connecting section, the two end portions respectively extend downward from the connecting section to the lid, and the two end portions are fixed on the lid.

5. The dust collector of claim 3, wherein the rod comprises a threaded section, the seat comprises a screwed mechanism, the threaded section is screwed to the screwed mechanism.

6. The dust collector of claim 3, wherein each base comprises a sleeve, the sleeve is adapted for the rod passing therethrough.

7. The dust collector of claim 1, wherein each operating rod is pivotally disposed on each base, so that each operating rod can pivot on an axis with respect to each base.

8. The dust collector of claim 1, wherein the operating rod comprises a sheath.

* * * * *